US010932967B2

(12) United States Patent
Haskett et al.

(10) Patent No.: US 10,932,967 B2
(45) Date of Patent: Mar. 2, 2021

(54) PERSONAL ASSISTIVE LIFT DEVICE AND RELATED METHODS

(71) Applicants: William F. Haskett, Chichester, NH (US); Helmut Koch, Concord, NH (US)

(72) Inventors: William F. Haskett, Chichester, NH (US); Helmut Koch, Concord, NH (US)

( * ) Notice: Subject to any disclaimer, the term of this patent is extended or adjusted under 35 U.S.C. 154(b) by 62 days.

(21) Appl. No.: 16/577,371

(22) Filed: Sep. 20, 2019

(65) Prior Publication Data

US 2020/0100959 A1 Apr. 2, 2020

Related U.S. Application Data

(60) Provisional application No. 62/738,552, filed on Sep. 28, 2018.

(51) Int. Cl.
*A61G 5/14* (2006.01)
*A47C 9/10* (2006.01)

(52) U.S. Cl.
CPC ..... *A61G 5/14* (2013.01); *A47C 9/105* (2013.01)

(58) Field of Classification Search
CPC ..... A61G 5/14; A47C 9/105; A45B 5/00
See application file for complete search history.

(56) References Cited

U.S. PATENT DOCUMENTS

| | | | | | |
|---|---|---|---|---|---|
| 2,629,429 | A * | 2/1953 | Baumfeld | A47C 9/105 | 297/58 |
| 5,265,689 | A * | 11/1993 | Kauffmann | A61G 5/042 | 180/65.51 |
| 5,332,283 | A * | 7/1994 | Gray | A47C 4/18 | 297/129 |
| 5,871,025 | A * | 2/1999 | Richter | A45B 3/00 | 135/65 |
| 6,783,179 | B2 * | 8/2004 | Komura | A61G 5/14 | 297/330 |
| 8,876,203 | B1 * | 11/2014 | Haertl | A47C 7/00 | 297/118 |
| 9,681,713 | B2 * | 6/2017 | Pao | A45B 5/00 | |
| 2004/0266591 | A1 * | 12/2004 | Alessandri | A63B 21/156 | 482/94 |
| 2013/0069407 | A1 * | 3/2013 | Park | F16F 9/0209 | 297/313 |
| 2017/0129524 | A1 * | 5/2017 | Wang | B62B 7/06 | |
| 2018/0055231 | A1 * | 3/2018 | Hamid | A47C 7/566 | |

* cited by examiner

*Primary Examiner* — David R Dunn
*Assistant Examiner* — Tania Abraham
(74) *Attorney, Agent, or Firm* — Hayes Soloway P.C.

(57) ABSTRACT

The disclosed personal assistive lift device is a self-operated device intended to a help a moderately disabled, yet still ambulatory, person regain a standing position after a fall. The disclosed personal assistive lift device includes a main leg and two support legs pivotably connected together, a seat movably affixed to the main leg, a handlebar positioned on a top portion of the main leg, and a module containing a gearmotor configured to move the seat along the main leg. A major advantage of the disclosed device is to allow the user to safely expand the range of activities and locations, whether indoor or outdoor, that the user can access.

13 Claims, 12 Drawing Sheets

PERSONAL ASSISTIVE LIFT DEVICE AND RELATED METHODS

FIELD OF THE DISCLOSURE

The present disclosure relates to a personal assistive lift device and, more particularly, to a self-operated personal assistive lift device that is portable and includes a folding tripod frame and a motorized seat that travels up one of the legs of the frame during operation, as well as related methods of manufacture and use.

BACKGROUND

Many people suffer from minor to moderate physical disabilities that make standing from various positions difficult. For example, numerous people are able to easily walk but cannot always regain a standing position after experiencing a fall. Additionally, it is common-place during recovery from certain surgical procedures to limit physical activities that involve rising from a prone position or a low sitting position (for example, during recovery from knee surgery). Many people with this particular type of physical impairment, whether it be temporary or more chronic, are able to lead normal lives, but may need some assistance to achieve a standing position in some circumstances.

When a person who has difficulty standing falls outside of an environment in which accommodations for this condition are present, they must rely on assistance from others to recover. At times, even the presence and assistance of others is not a complete solution as many people do not possess the strength or skill to lift another person to their feet. A person with physical difficulty standing may thus have limited ability to engage in many indoor and/or outdoor activities in which the risk of a fall exists and adequate assistance may not be immediately available.

SUMMARY

The disclosed personal assistive lift device is a self-operated device intended to a help a moderately disabled, yet still ambulatory, person regain a standing position after a fall. The presently disclosed personal assistive lift device includes, in some embodiments, a main leg and two support legs pivotably connected to move into a closed position in which the legs are parallel and an open position in which the legs form a tripod. The disclosed personal assistive life device also includes a seat movably affixed to the main leg, a handlebar positioned on the top portion of the main leg and a module containing a gearmotor configured to move the seat along the main leg. The disclosed personal assistive lift device may also include a spreader with hingedly connected components to join the main leg and the two support legs at a central point. Various other features and details of the disclosed personal assistive lift device are described more fully in the following sections.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

FIG. 1A illustrates the exemplary personal assistive lift device in an open position and FIG. 1B illustrates the exemplary personal assistive lift device in a closed position. FIG. 1B also illustrates two distinct views of the personal assistive lift device.

FIGS. 1E and 1F illustrate a side view of the leg attachment block and FIGS. 1G and 1H illustrate bottom view of the leg attachment block. In FIGS. 1E and 1G, the support legs are in an open position and in FIGS. 1F and 1H, the support legs are in a closed position.

DETAILED DESCRIPTION

The disclosed personal assistive lift devices are capable of assisting a user in regaining a standing position. In some cases, the user is physically able to move himself or herself from a seated position (for example, torso positioned at least two feet above the ground) to a standing position. The disclosed personal assistive lift devices may, in some embodiments, transport a user from a laying position to a seated position and then the user may rise using their own strength from a seated position to a standing position (possibly using arm and/or leg strength). A user of the disclosed personal assistive lift devices may also be capable of moving himself or herself onto the device while laying and/or seated on the ground. As will be more fully described below, the seat of the device may either rest on the ground or may be positioned at some distance from the ground. Thus, a user of the disclosed device should, ideally, be able to move himself or herself onto the seat of the device prior to use. Functioning hands and arms are thus preferable for using the disclosed devices. Structural features of the exemplary personal assistive lift devices as disclosed herein are described in detail below.

Structural Overview

Figure 1A:
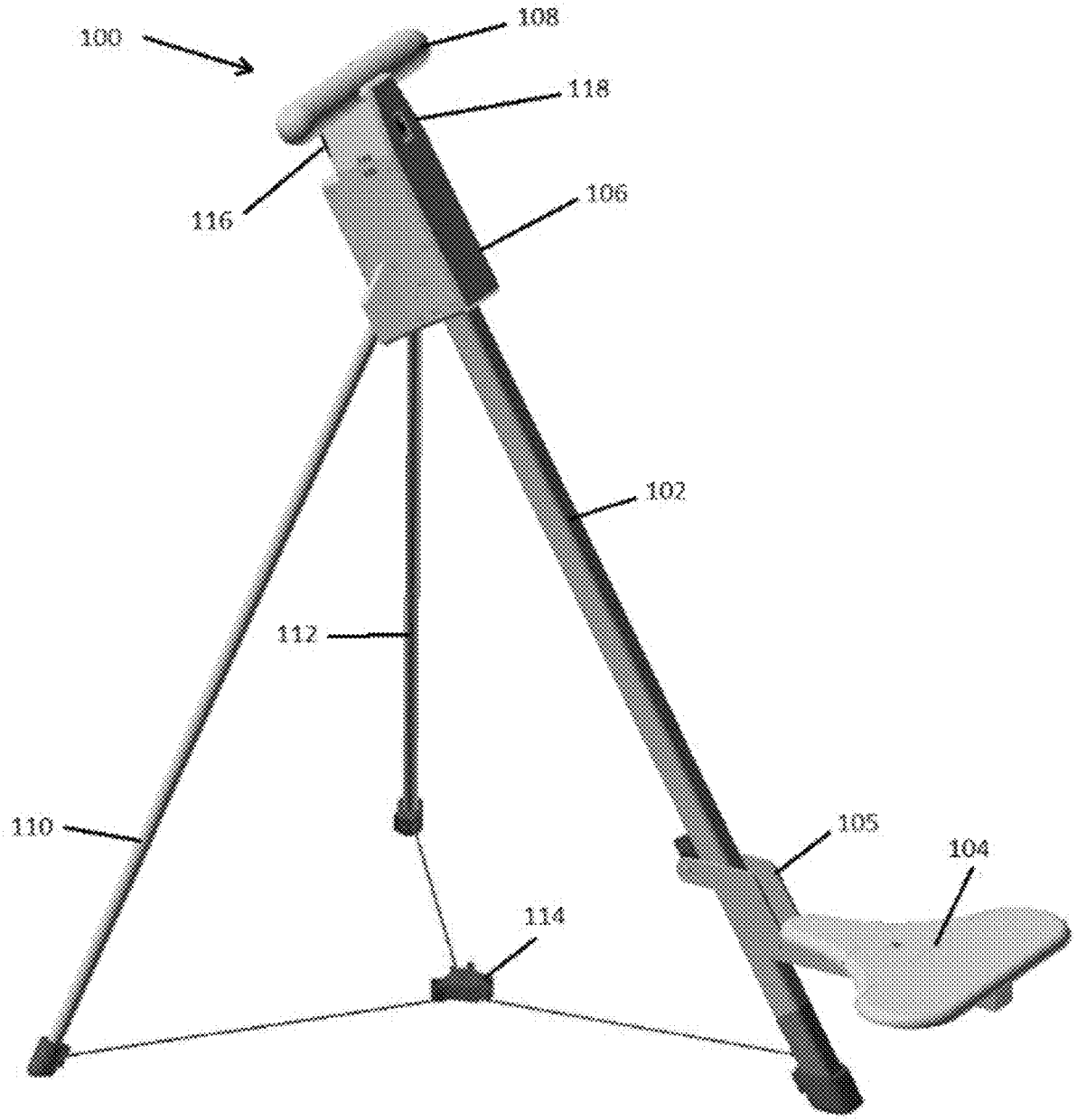
FIGS. 1A-1B illustrate perspective engineering drawings of an exemplary personal assistive lift device, in accordance with some embodiments of the subject disclosure. In particular.
Figure 1B:
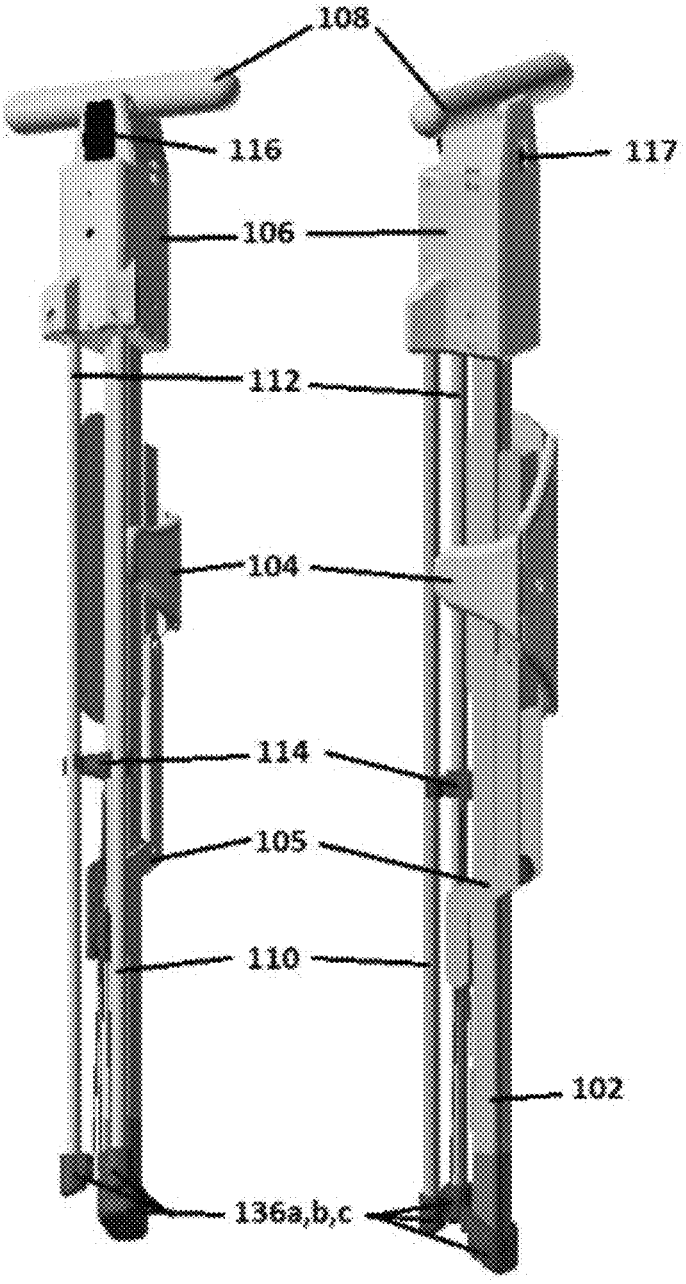
Figure 1C:
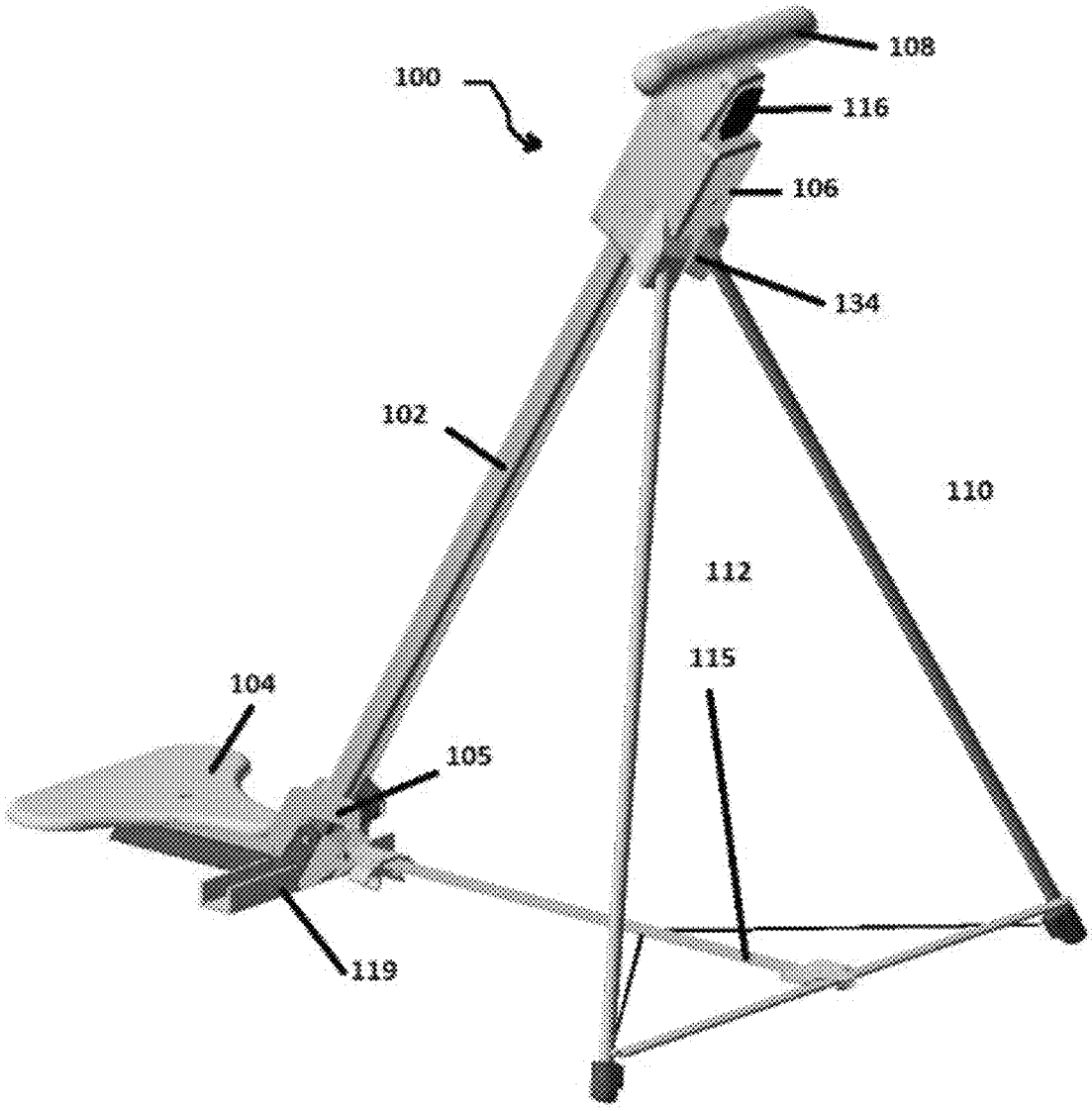
FIG. 1C illustrates an exemplary personal assistive lift device in which the support legs include a leg attachment block that allow the support legs to pivot between a closed position and an open position.

FIGS. 1A-1B illustrate an exemplary personal assistive lift device 100. In particular, FIG. 1A illustrates the personal assistive lift device 100 in an open position and FIG. 1B illustrates the personal assistive lift device 100 in a closed position. Throughout the subject disclosure, the disclosed personal assistive lift device 100 is at times referred to simply as "device 100" or just "device." As shown in FIGS. 1A and 1B, device 100 includes a main leg 102 with a moveable seat 104 affixed thereto, a module 106 containing a gearmotor (discussed in detail with respect to FIGS. 2A-2B), which controls movement of the seat 104 (as well as various additional components), and a handlebar 108 positioned above the module 106 on the main leg 102. Two support legs 110, 112 are hingedly connected to the main leg 102 (either directly or via module 106). In the exemplary embodiment of device 100 shown in FIGS. 1A and 1B, the positioning of bottom portions of main leg 102 and support legs 110, 112 are constrained by spreader cable and cable management clip 114. However, as described herein, other configurations for main leg 102 and support legs 110, 112 are also possible. For example, FIG. 1C illustrates an alternative solid folding leg spreader 115 that provides extra stability to the tripod configuration. As shown in FIG. 1C, an auxiliary support platform 119, which is placed outside of the tripod leg base, may be used when a lower starting position of the seat is desired.

Prior to use, device 100 can be oriented as shown in FIG. 1A, with seat 104 positioned on main leg 102 at a point low to the ground. To use device 100, a user may sit on seat 104 and grip handlebar 108 with their hands. The positioning of handlebar 108 and seat 104 encourage proper balance naturally and also advantageously position the user's center of gravity within the footprint of the device 100, thereby ensuring stability of device 100 during use.

As shown in FIGS. 1A and 1B, device 100 may take the basic form of a tripod (formed by main leg 102 and support legs 110, 112). This tripod shape provides maximum stability and strength with a minimum of materials and weight. As discussed in detail in the following paragraphs, all of the basic functionality and strength can reside in the main leg 102. The two supporting legs 110, 112, along with spreader 114 (if present) set the proper angle of operation to maintain balance during the lifting process.

Figure 1D:
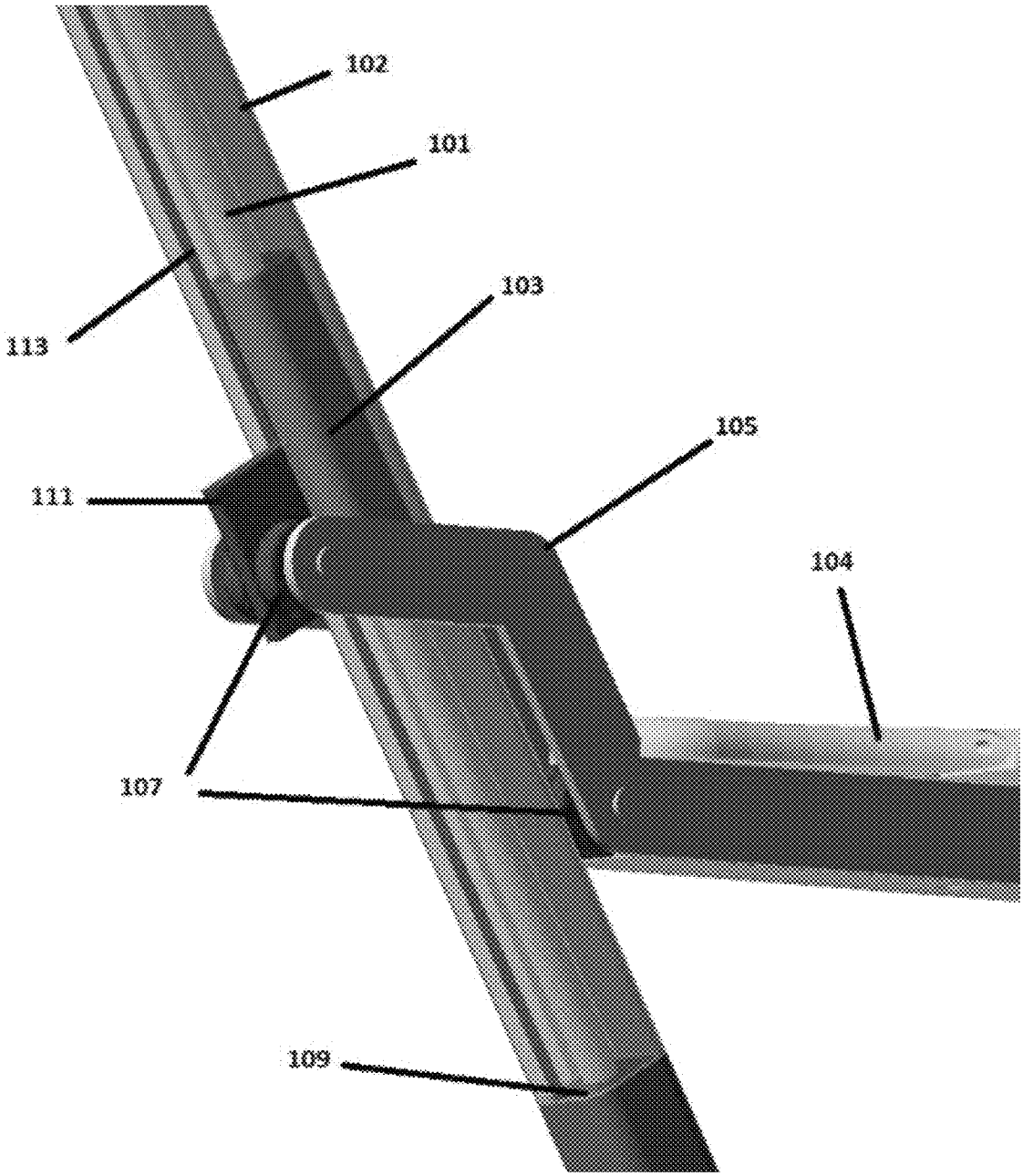
FIG. 1D illustrates an exemplary carrying structure for a personal assistive lift device, in accordance with some embodiments of the subject disclosure.

Main leg 102 may be implemented with any suitably rigid material. In some embodiments, main leg 102 may be formed of steel, aluminum, and/or a composite material. In select embodiments, main leg 102 may be a square aluminum tube. Main leg 102 includes a carrying structure 105 for seat 104 that moves along main leg 102. Carrying structure 105 may be implemented with any material used to form main leg 102 or with a different material. In some embodiments, as shown in FIG. 1D, carrying structure 105 includes a leadscrew 101 and a leadscrew nut 103 positioned internal to main leg 102 to move seat 104 along main leg 102. In a specific embodiment, main leg 102 is implemented with a square tube of extruded aluminum including an 8 mm×700 mm ACME leadscrew in the center. In some embodiments, the leadscrew 101 may have a thread pitch of 2 mm and leads of 1, 2, or 4. As will be appreciated by those skilled in the art, the lead and pitch of the leadscrew 101 directly impacts the speed at which the leadscrew nut 103 travels and the lifting force generated for a given motor torque. A smaller lead may be selected if a lower speed travel and greater lifting capacity are desired and vice versa. In these and other embodiments, carrying structure 105 includes ball bearings 107 that ride on main leg 102 to control the angle of the seat 104 and allow it to ride smoothly up and down the main leg 102.

As shown in FIG. 1D, a thrust bearing 109 supporting the leadscrew 101 can also be included underneath main leg 102. In some such embodiments, a smaller square aluminum extrusion connected to the leadscrew nut 103 may travel the length of the main leg 102 as the leadscrew 101 is rotated by the gearmotor 120 at the top. A gap 113 on the length of one face of the main leg 102 may also be included to allow a flange 111 on the carrying structure 105 to connect to the seat 104. Numerous configurations and variations are possible and contemplated.

As shown in FIGS. 1A and 1B, a module 106 may be positioned near the top of main leg 102. In some embodiments, module 106 includes a gearmotor 120 that drives the lead screw 101 to raise and/or lower the seat 104 on main leg 102. The top module 106 may also contain batteries, charging circuitry, limit switches, support leg hinges, and/or user control switches, depending on the desired specifications and configuration of the device.

The two support legs 110, 112 may be formed of simple aluminum tubes that are connected to the main leg 102 at or near module 106. In some embodiments, the support legs 110, 112 may be hingedly connected to the main leg 102, however, in other embodiments, the device 100 may include sockets into which the support legs 110, 112 and main leg 102 may be placed to secure the device 100 in an open position. In embodiments in which the device 100 includes sockets for support legs 110, 112, each support leg 110, 112 may include two sockets, one for accommodation in a closed position and one for accommodation in an open position.

Figure 1E:
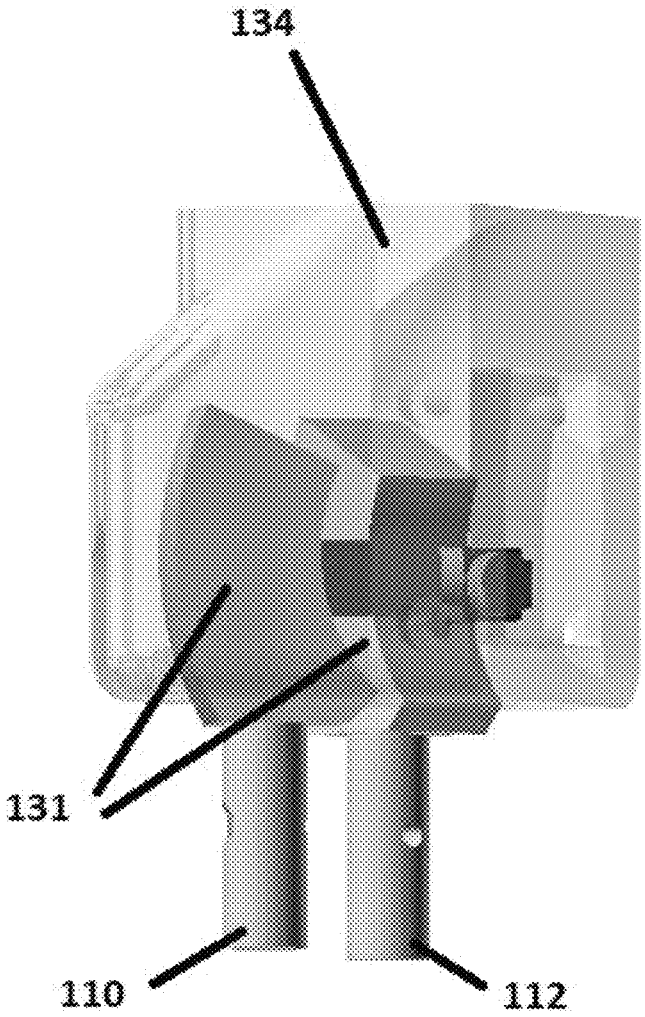
FIGS. 1E-1H illustrate features of an exemplary leg attachment block (particularly the pivot mechanism).
Figure 1F:
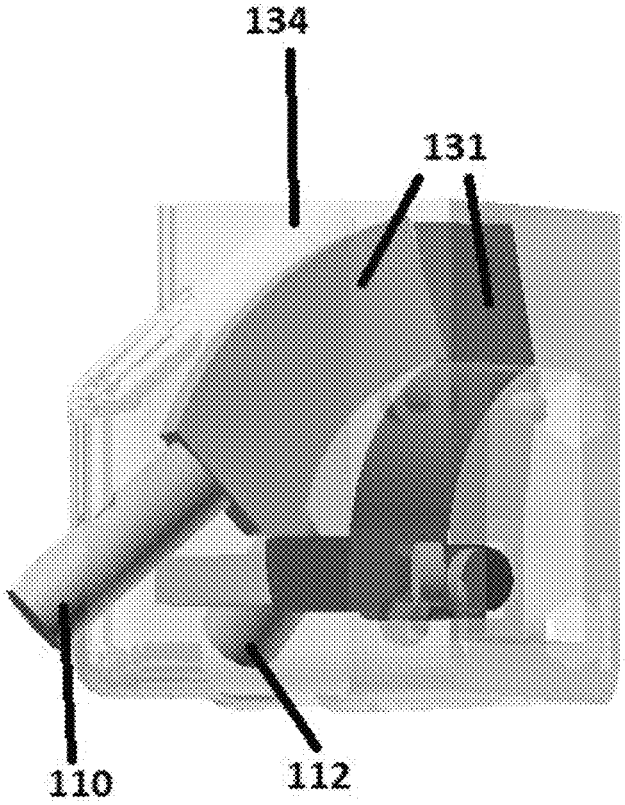

As shown in FIG. 1C, to support the various leg attachment methods, a portion of module 106 may be formed as a separable leg attachment block 134. In embodiments in which the support legs 110, 112 and the main leg 102 are hingedly connected, a sliding pivot may be used. FIGS. 1E and 1F illustrate an exemplary leg attachment block 134, with FIG. 1E illustrating the leg attachment block 134 in an open position and FIG. 1F illustrating the leg attachment block 134 in a closed position. As shown in FIGS. 1E and 1F, support legs 110, 112 in a leg pivot block 131 that is slid through a curved channel to move support legs 110, 112 between a closed position and an open position.

As shown in FIGS. 1A and 1B, a cable spreader and clip 114 may connect bottom portions of the main leg 102 and support legs 110, 112. Spreader 114 may include three flexible wire cables or thin ropes attached to each leg and commonly to a central clip, which manages the cables and holds the legs together in a closed position. The presence of the cable spreader components assures that all forces on the legs are longitudinal, advantageously allowing the leg attachment and tube components to require less strength. When in an open position (as shown in FIG. 1A), spreader 114 may limit the position of support legs 110, 112 to have an angle with respect to one another of 45 degrees, and the plane of the support legs 110, 112 to be at an angle of 45 degrees to the main leg 102. The length of the legs (102, 110, 112) can be such that the main leg 102 is at a 30-degree tilt from perpendicular when deployed. Numerous angle configurations for main leg 102 and support legs 110, 112 are also possible and contemplated herein. For example, in some embodiments, the support legs 110, 112 may be positioned at an angle within 10% or 20% of 45° to the main leg 102. In some such embodiments, the support legs 110, 112 may extend to be at an angle of between 36° and 54° or between 40° and 50° to the main leg 102. In these and other embodiments, the main leg 102 may be configured to be positioned at within 10% and 20% of 30° from perpendicular when deployed. In some such embodiments, the main leg 102 may be positioned at between 24° and 36° from perpendicular, such as between 27° and 33°, in select embodiments.

FIG. 1C illustrates an alternative spreader 115 configuration in which an additional support is positioned between the support legs 110, 112. Spreader 115 shown in FIG. 1C includes a central bar that is hinged at the bottom of main leg 102 and lies parallel to main leg 102 when in a stowed position and parallel to the ground when in an open position. Two side leg bars are attached to the central bar and an angled hinge allows the side bars to be parallel with the central bar when closed and to form a "T" with the central bar when open. The side bars can attach to the support legs 110, 112 either by manual connection when open or by a multi-axis hinge that can slide on each of the support legs 110, 112. In these and other embodiments, components of spreader 115 may be lockable to secure the personal assistive lift device 100 in an open position.

Figure 1G:
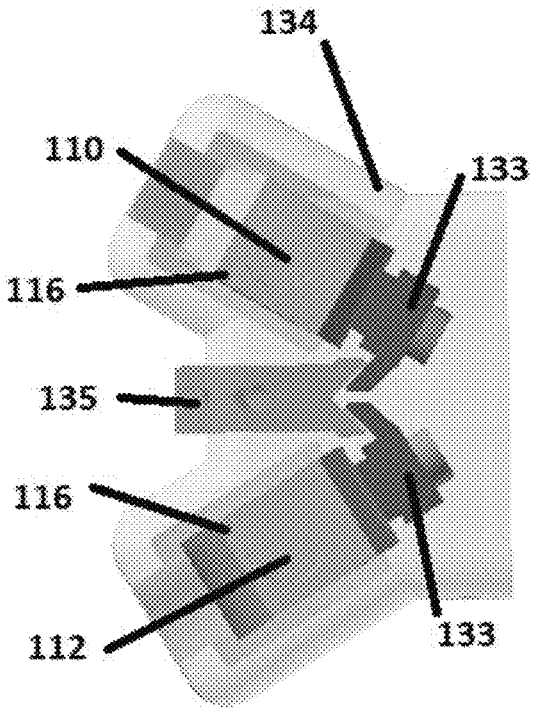
Figure 1H:
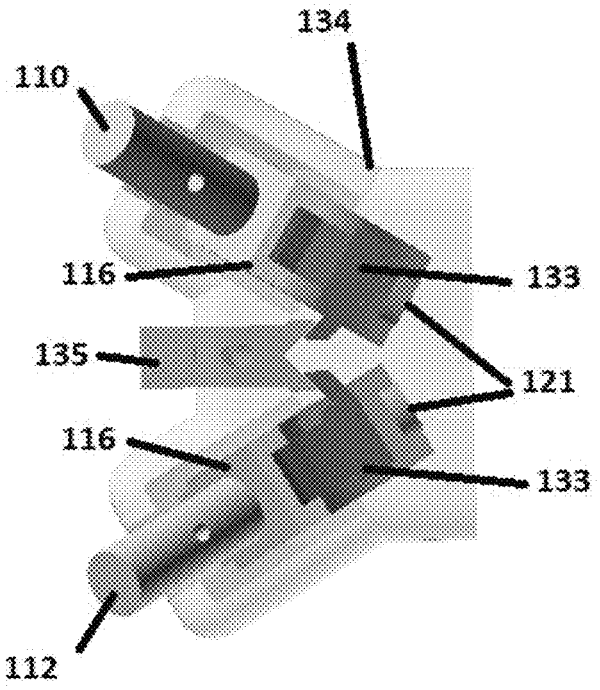

The rigid spreader arrangement 115 is more important with hingedly attached legs if there is no alternative mechanism to maintain the open position of the legs. In some embodiments, for example, a leg latch may be used to fix support legs 110, 112 in an open position relative to main leg 102, allowing use of the simpler cable spreader 114. FIGS. 1E-1H illustrate an exemplary leg attachment block 134 having a leg latching feature. FIGS. 1G and 1H illustrate a bottom view of leg attachment block 134. In FIG. 1G, support legs 110, 112 are in a closed position and in FIG. 1H, support legs 110, 112 are in an open and latched position. FIGS. 1E and 1F illustrate a side view of the leg attachment block 134 shown in FIGS. 1G and 1H. In FIG. 1E, the support legs 110, 112 are in a closed position and in FIG. 1F, support legs 110, 112 are in an open and latched position. While the support legs 110, 112 attached to pivot blocks 116 are stowed, the latch pins 133 are held retracted by the pivot blocks 116. When the support legs 110, 112 are fully opened, the latch pins 133 can protrude into the pivot channel, blocking the closing of the legs. The latches are forced to the locked position by the repulsion of opposing magnets attached to both the latch pins 133 and the leg attachment block 134. To return the support legs 110, 112 to a stowed position, the release button 135 may be depressed, moving the latch pins 133 out of the pivot channel.

If desired, device 100 may be equipped with feet 136*a*, 136*b*, 136*c*, as shown in FIG. 1C. If present, feet 136*a*, 136*b*, 136*c* may provide a flat contact point with the ground for main leg 102 and support legs 110, 112. Feet 136*a*, 136*b*, 136*c* may include a rubberized bottom surface to prevent damage to underlying surfaces, in some embodiments. If desired, feet 136*a*, 136*b*, 136*c* may include spikes or other gripping components to resist slipping on soft or icy underlying ground.

As illustrated in FIG. 1D, the carrying structure 105 for seat 104 may include two arms that straddle the main leg 102 and connect to the leadscrew. These arms may, in some embodiments, carry two sets of ball bearings 107 that ride on the outside of the main leg 102 to transfer the weight of the user to the main leg 102 (and indirectly to support legs 110, 112). The bearings, if present, may be arranged to support the seat 104 at 30 degrees from perpendicular during use. In these and other embodiments, carrying structure 105 may be pivotable around main leg 102 to, for example, allow seat 104 to be compactly stored (see FIG. 1B). Specifically, carrying structure 105 may be pivoted to be parallel with the main leg 102. To further promote compact storage, seat 104 may be rotatable on carrying structure 105 and also foldable (see FIG. 1B).

As previously mentioned, module 106 includes various operative components of device 100, including a gearmotor 120. FIGS. 2A-2B and 3A-3B illustrate some possible components of module 106, which are discussed below in detail. The gearmotor 120 is the primary mover, directly driving the leadscrew at the top of the main leg 102. The power rating of the gearmotor 120 is the ultimate determinant of how fast the lifting process can proceed.

The other factor affecting lifting capability and speed is the 'lead' of the leadscrew, which, in some embodiments, may be more than, less than, or equal to 2 mm per revolution. In some embodiments, a maximum lifting capability of approximately 300 lbs may be achieved. A full lift at the given lead may, in some embodiments, require approximately 300 revolutions. Assuming a max load RPM of 150, this calculates to a lift duration of 2 minutes. Lower weight would lift somewhat faster, but probably at least 1½ minutes. Ultimately, these details can be scaled to meet any desired specification of device 100. For example, device 100 may be configured to safely lift at least 200 lbs, 250 lbs, 275 lbs, 300 lbs, 325 lbs, 350 lbs, or at least 400 lbs, in some embodiments. In some embodiments, device 100 provides lifting capabilities of at least 23 inches, such as at least 25 inches, 28 inches, 30 inches, 32 inches, 34 inches, or 36 inches.

The gearmotor 120 may operate from a nominal 4V or 8V source, for example, one or two AA-sized lithium cells in series. At 3.7V and 2000 maH each, these cells can easily supply the power requirements of the device 100. More robust versions of the device 100 may well be powered by 18V or ever 24V, as many portable power tools are equipped. A built-in charging circuit may also be included, requiring an external DC adapter. In some such embodiments, a full charge should accommodate multiple lifting cycles. In select embodiments, a single cell (4V) rechargeable screwdriver and a two cell (8V) rechargeable drill may be used as the gearmotor 120 for device 100.

Figure 2A:
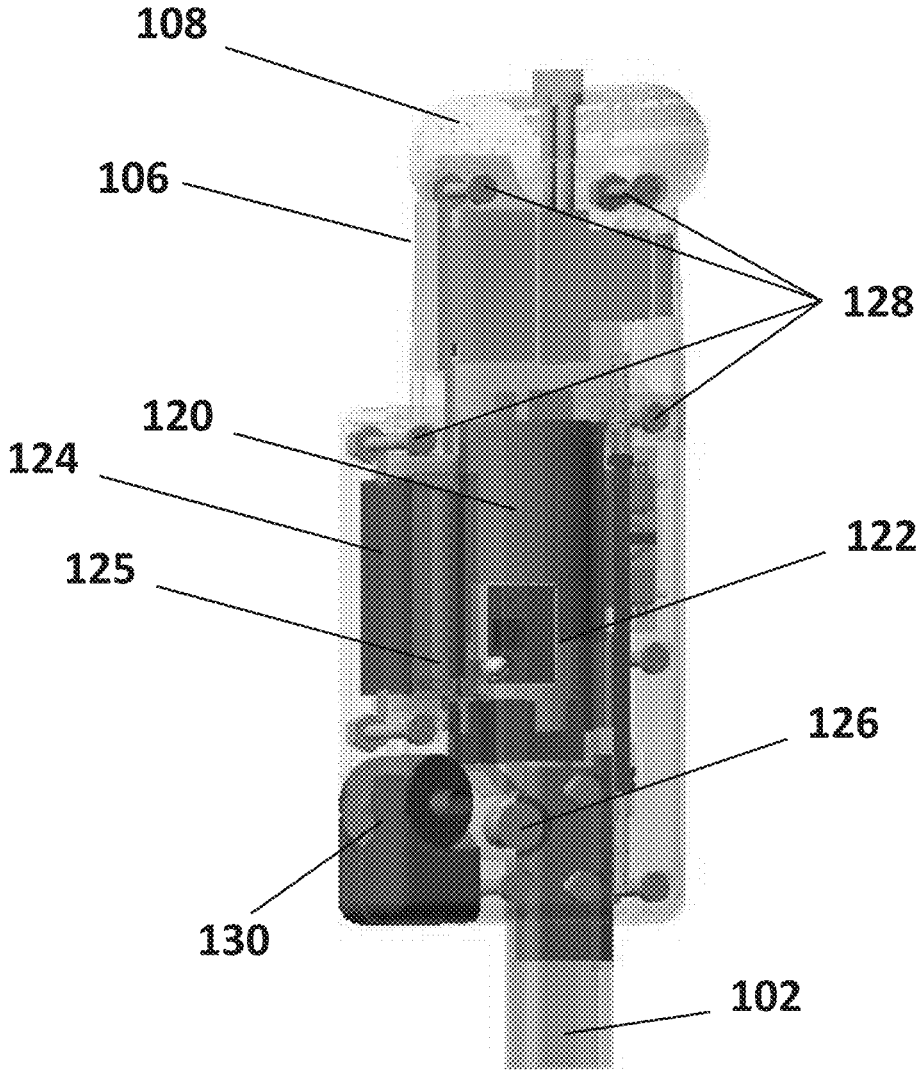
FIGS. 2A-2B illustrate perspective engineering drawings of components of an exemplary module for a personal assistive lift device, in accordance with some embodiments of the subject disclosure.
Figure 2B:
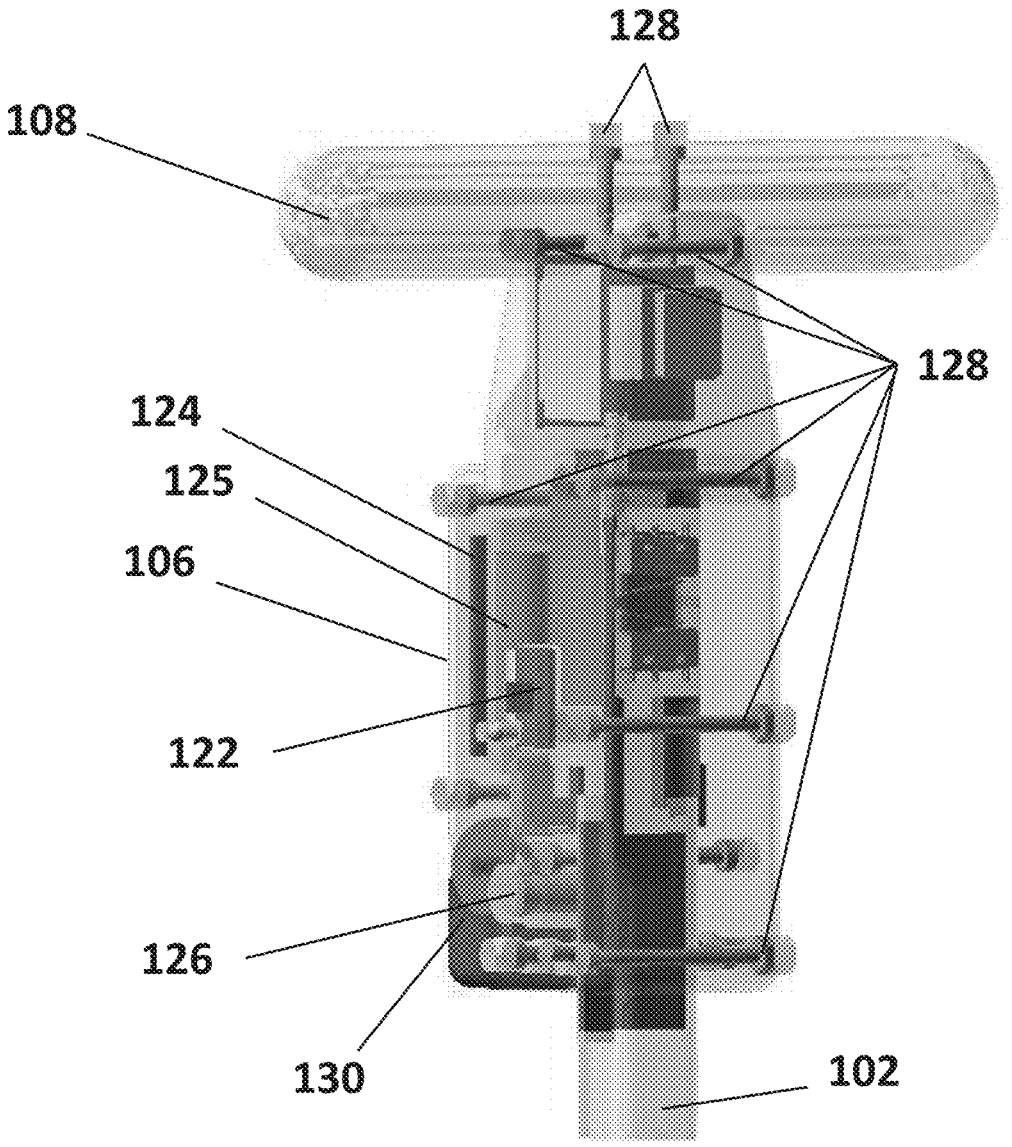

In addition to gearmotor 120, module 106 also includes various other desired componentry. FIGS. 2A-2B illustrate an exemplary module 106 from various angles. As shown in FIGS. 2A-2B, module 106 may contain gearmotor 120, a regulator 122 for the charging circuit, a safety circuit for a rechargeable power source (e.g., lithium batteries) 125, and/or a DC power adapter 126. Numerous arrangements of these or other components within module 106 are possible and contemplated. As shown in FIGS. 2A-2B, module 106 may also include a rigid outer housing held together by a plurality of screws 128. In some embodiments, module 106 may also be formed with a leg attachment block 134 in an exterior lower portion to which support legs 110, 112 may be hingedly mounted or fit into fixed sockets.

Device 100 may include one or more switches to control operation of the device. In some embodiments (as shown in FIGS. 2A and 2B), movement of seat 104 along main leg 102 is controlled by two switches, one being a primary toggle switch 116 to facilitate actual movement of the seat and the other being a safety switch 118, which must be engaged for the primary toggle switch to successfully actuate movement. The purpose of the safety switch 118 is twofold. First, safety switch 118 can prevent accidental activation from external objects that may press on the primary toggle switch 116 during transport. Second, safety switch 118 may help ensure that the user's hands are in the proper position on the handlebars 108 during operation. The safety switch 118 may, if present, be a recessed push button or a different type of switch mechanism. Device 100 may be further protected by two limit switches at the ends of travel for the seat 104. The primary toggle switch 116 and safety switch 118 may be positioned close enough together to allow for simultaneous engagement with a single hand of the user, in some embodiments.

Figure 4A:
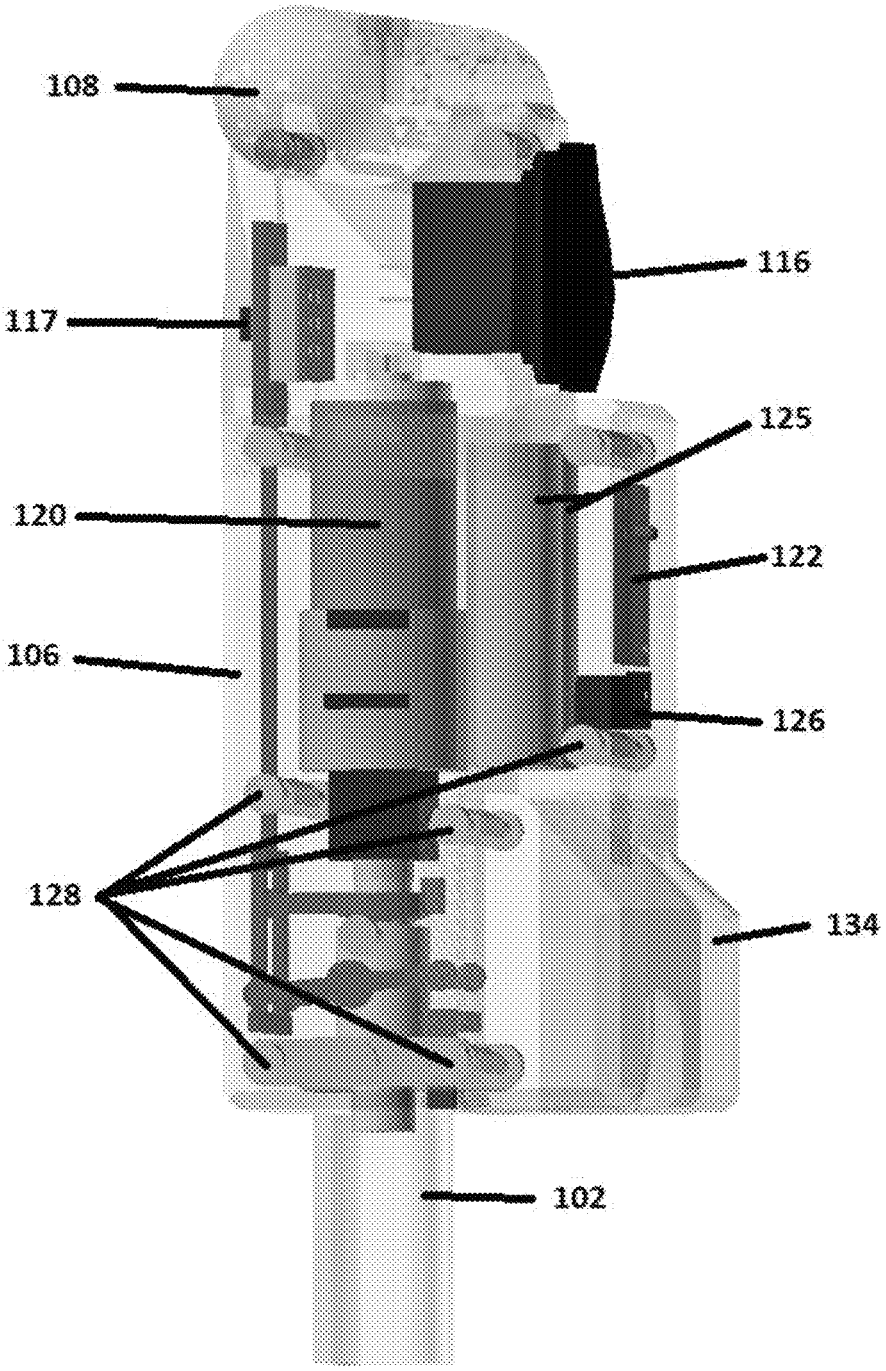
FIGS. 4A and 4B illustrate perspective engineering drawings of exemplary switching devices that may be used to control the disclosed personal assistive lift device, in accordance with some embodiments of the subject disclosure As will be appreciated, the figures are not necessarily drawn to scale or intended to limit the disclosure to the specific configurations shown. For instance, while some figures generally indicate straight lines, right angles, and smooth surfaces, an actual implementation of the disclosed devices may have less than perfect straight lines, right angles, and smooth surfaces. In other words, the figures are provided merely to show some possible example structures. Additionally, for purposes of clarity, not every component may be labelled in every figure. Furthermore, as will be appreciated in light of this disclosure, the accompanying drawings are not intended to be drawn to scale or to limit the described embodiments to the specific configurations shown.
Figure 4B:
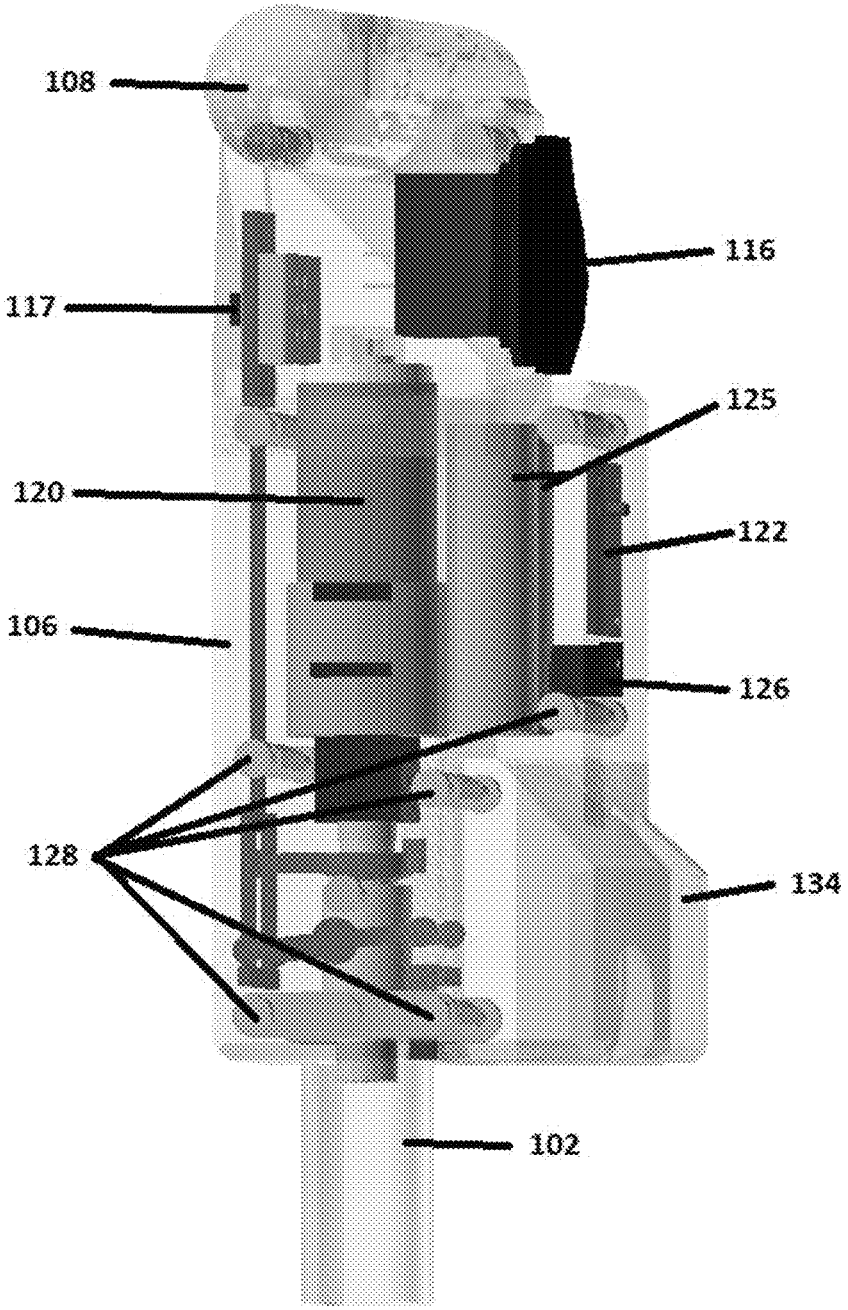

In other embodiments, as illustrated in FIGS. 4A and 4B, the device 100 may be controlled by a toggle switch and a second slide switch 117. In some such embodiments, the second slide switch has three positions: up, off (neutral), and down. The device is moved in an upward motion when the second slide switch is positioned up and the toggle switch is activated. Conversely, the device is moved in a downward motion when the second slide switch is positioned down and the toggle switch is activated. When the second slide switch is positioned in neutral, activation of the toggle switch will not cause the device to move. The slide switch may be fitted with mechanical interlocks, 121, 123, and 127 which respond to movements of the seat carrier 105, such that the slide switch 117 is forced to its 'off' position and gearmotor 120 is disabled at the limits of normal range of motion. Alternative switch arrangements are also possible.

Figure 3A:
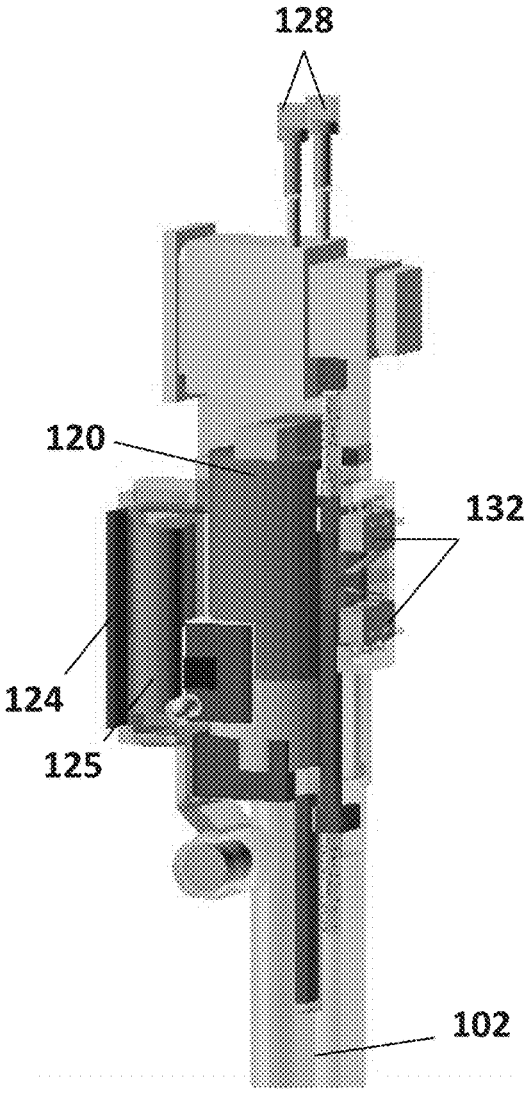
FIGS. 3A-3B illustrate perspective engineering drawings of components of an exemplary module for a personal assistive lift device, in accordance with some embodiments of the subject disclosure.
Figure 3B:
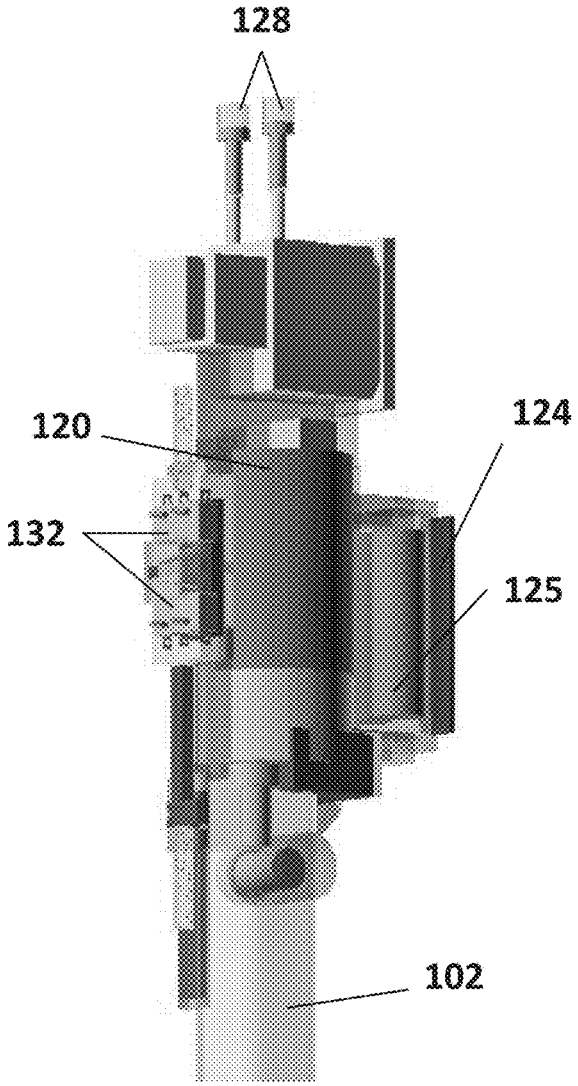

FIGS. 3A and 3B illustrate components of an exemplary module 106 shown without the module's rigid housing. In particular, FIGS. 3A and 3B illustrate switching components 132, which may be controlled by safety switch 118 and/or primary toggle switch 116. As shown in FIGS. 3A and 3B, switching components 132 may be operatively connected to gearmotor 120. Module 106 may also include safety circuit 124 for a rechargeable power source 125, as illustrated in FIGS. 3A and 3B.

A major advantage of the disclosed device is to allow the user to safely expand the range of activities and locations, whether indoor or outdoor, that the user can access. This requires easy portability, part of which may be accomplished by hinging the two support legs 110, 112 so that they can fold parallel to the main leg 102. In order to minimize the strength, and corresponding weight, required for these legs and hinges, folding spreaders may also be incorporated to limit the extension of the support legs 110, 112. The seat 104 and associated carrying structure 105 with the leadscrew nut have also helpfully been designed to fold up into a smaller configuration around the main leg 102. In this compact configuration, the device can conveniently fit into a slim carrying bag that provides easy portability for most walking activities.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes, and not to limit the scope of the inventive subject matter described herein. The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The invention claimed:

1. A portable assistive lift device comprising:

a main leg having a top portion and a bottom portion;

a seat movably attached to the main leg;

a module affixed to the top portion of the main leg, wherein the module contains a gearmotor configured to move the seat along the main leg in a first direction toward the top portion and in a second direction toward the bottom portion;

a handlebar positioned on the top portion of the main leg;

a first support leg having a top portion connected to the main leg and a bottom portion;

a second support leg having a top portion connected to the main leg and a bottom portion;

a spreader connecting the bottom portions of the main leg, the first support leg, and the second support leg.

2. The portable assistive lift device of claim 1, wherein the main leg, the first support leg, and the second support leg are moveable into a closed configuration in which the main leg, the first support leg, and the second support leg are parallel, and moveable into an open configuration in which the main leg, the first support leg, and the second support leg form a tripod.

3. The portable assistive lift device of claim 1, wherein the module further comprises a primary toggle switch that operates the gearmotor.

4. The portable assistive lift device of claim 3, wherein the module further comprises a safety switch, and the primary toggle switch can only engage the gearmotor when the safety switch is also engaged.

5. The portable assistive lift device of claim 1, wherein the spreader is a rigid spreader that retains the first support leg at an angle of 45° relative to the second support leg.

6. The portable assistive lift device of claim 1, wherein the spreader is a flexible cable spreader and a latched pivot retains the first support leg at an angle of 45° relative to the second support leg.

7. The portable assistive lift device of claim 1, wherein the spreader is a rigid spreader and retains the main leg at an angle of 30° from perpendicular.

8. The portable assistive lift device of claim 1, wherein the spreader is a flexible cable spreader and a latched pivot retains the main leg at an angle of 30° from perpendicular.

9. The portable assistive lift device of claim 1, further comprising a carrying structure onto which the seat is rotatably mounted, wherein the carrying structure is pivotably affixed to the main leg.

10. The portable assistive lift device of claim 1, wherein the module further comprises a regulator for a charging circuit, a safety circuit for a rechargeable power source, and a DC power adapter.

11. The portable assistive lift device claim 1, wherein the first support leg and the second support leg are hingedly connected to a rigid housing of the module on the main leg.

12. The portable assistive lift device of claim 1, wherein the first support leg and the second support leg are connected to sockets in a rigid housing of the module on the main leg.

13. The portable assistive lift device claim 1, wherein the device can safely lift at least 300 lbs.

* * * * *